US008082609B2

(12) United States Patent
Rydalch

(10) Patent No.: US 8,082,609 B2
(45) Date of Patent: Dec. 27, 2011

(54) WALK-IN BATHTUB HAVING A FLIP-UP SEAT PORTION OVER A REARWARD FOOT WELL RECESS

(75) Inventor: Robert S. Rydalch, Middleton, ID (US)

(73) Assignee: Best Bath Systems, Inc., Caldwell, ID (US)

( * ) Notice: Subject to any disclaimer, the term of this patent is extended or adjusted under 35 U.S.C. 154(b) by 1306 days.

(21) Appl. No.: 11/657,953

(22) Filed: Jan. 25, 2007

(65) Prior Publication Data

US 2008/0178380 A1 Jul. 31, 2008

(51) Int. Cl.
*A47K 3/022* (2006.01)

(52) U.S. Cl. ..... 4/590; 4/556; 4/559; 4/579

(58) Field of Classification Search ..... 4/555, 556, 4/578.1, 579, 590; 297/44, 331, 337, 283, 297/14, 188.1, 284.11
See application file for complete search history.

(56) References Cited

U.S. PATENT DOCUMENTS

| | | | | |
|---|---|---|---|---|
| 2,899,688 | A | | 8/1959 | Hopkins |
| 3,579,668 | A | | 5/1971 | Aronovitz |
| D332,827 | S | | 1/1993 | Dannenberg |
| 5,343,576 | A | * | 9/1994 | Dannenberg et al. ..... 4/590 |
| 5,475,880 | A | * | 12/1995 | Guenther ..... 4/571.1 |
| 5,974,600 | A | * | 11/1999 | Pucci et al. ..... 4/498 |
| 6,056,359 | A | * | 5/2000 | Clark ..... 297/237 |
| 2005/0044620 | A1 | * | 3/2005 | Metcalf ..... 4/556 |
| 2005/0102746 | A1 | | 5/2005 | Wright |

FOREIGN PATENT DOCUMENTS

GB 2319957 A * 6/1998

* cited by examiner

*Primary Examiner* — Huyen Le
*Assistant Examiner* — Bradley Oliver
(74) *Attorney, Agent, or Firm* — Charles R. Clark

(57) ABSTRACT

A walk-in bathtub having a flip-up seat portion over a rearward foot well recess provides a bather with improved access to an interior bathing cavity of the bathtub by giving the bather when the bather is within the bathtub more usable floor space in the bathtub in which to stand while closing or opening a hinged door in a side wall of the bathtub. The invention further aids a bather in standing up from a sitting position in the bathtub in that the bather can place a foot or feet more directly below the bather in a rearward foot well recess under the flip-up seat portion preferably located near or at knee height and then can lift up the flip-up seat portion while the bather is rising from a sitting to a standing position.

4 Claims, 5 Drawing Sheets

WALK-IN BATHTUB HAVING A FLIP-UP SEAT PORTION OVER A REARWARD FOOT WELL RECESS

CROSS-REFERENCE TO RELATED APPLICATIONS

Not applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

In modern society, a bathtub is becoming more frequently a walk-in bathtub having a hinged door in a bather entryway through a side tub wall and having a compressible door seal closing and sealing the door. The bather entryway is used by a bather to enter and exit the bathtub.

BRIEF SUMMARY OF THE INVENTION

The present invention is a walk-in bathtub having a flip-up seat portion over a rearward foot well recess that provides a bather with improved access to an interior bathing cavity of the bathtub by giving the bather when the bather is within the bathtub more usable floor space in the bathtub in which to stand while closing or opening a hinged door in a side wall of the bathtub.

A further object of the invention is to aid a bather in standing up from a sitting position in the bathtub in that the bather can place a foot or feet more directly below the bather in a rearward foot well recess under the flip-up seat portion and then can lift up the flip-up seat portion while the bather is rising from a sitting to a standing position.

A further object is to provide a rugged and durable flip-up seat portion that is aesthetically pleasing to a bather and provides comfortable seating.

The present invention incorporates a secure, uncomplicated relatively unbreakable and inexpensively produced flip-up seat portion over a rearward foot well recess and thereby provides an improved walk-in bathtub.

Additional and various other objects and advantages attained by the invention will become more apparent as the specification is read and the accompanying figures are reviewed.

DETAILED DESCRIPTION OF THE INVENTION

Referring to FIGS. 1 through 10, the present invention is an improved walk-in bathtub 2 having a flip-up seat portion 24 over a rearward foot well recess 32.

Figure 1:
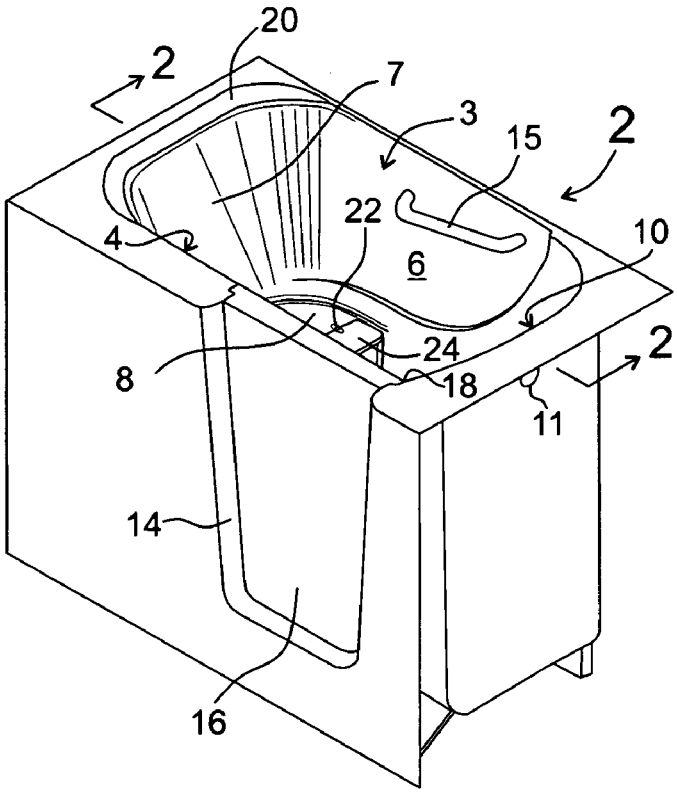
FIG. 1 is a simplified perspective view of an improved walk-in bathtub having a sealable hinged door and a flip-up seat portion over a rearward foot well recess.

FIG. 1 shows a walk-in bathtub 2 preferably made primarily of molded gelcoat fiberglass reinforced plastic construction having an interior bathing cavity 3, the interior bathing cavity defined by sidewalls 4, 5, 6, and 10 and a bottom wall 12. One of the sidewalls is a contoured molded seat rear end wall 5 opposite one of the side walls being a front end wall 10. One side wall 4 has a bather entryway 14 that allows a bather to enter and exit the bathtub 2. Preferably, the side wall 6 opposite the entryway 14 has a bather safety grab bar 15 attached on its inwardly facing surface near its upper edge as a balance and support aid for a bather in using the bathtub 2. An inwardly swinging sealable entryway hinged door 16 is mounted in the bather entryway 14 by a door hinge 18 adjacent to the front end wall 10 and the door selectively can be swung open to allow bather access to the bathtub or swung closed to seal the entryway. The door 16 is preferably selectively secured in the closed position by operation of a door latch assembly 19.

Figure 2:
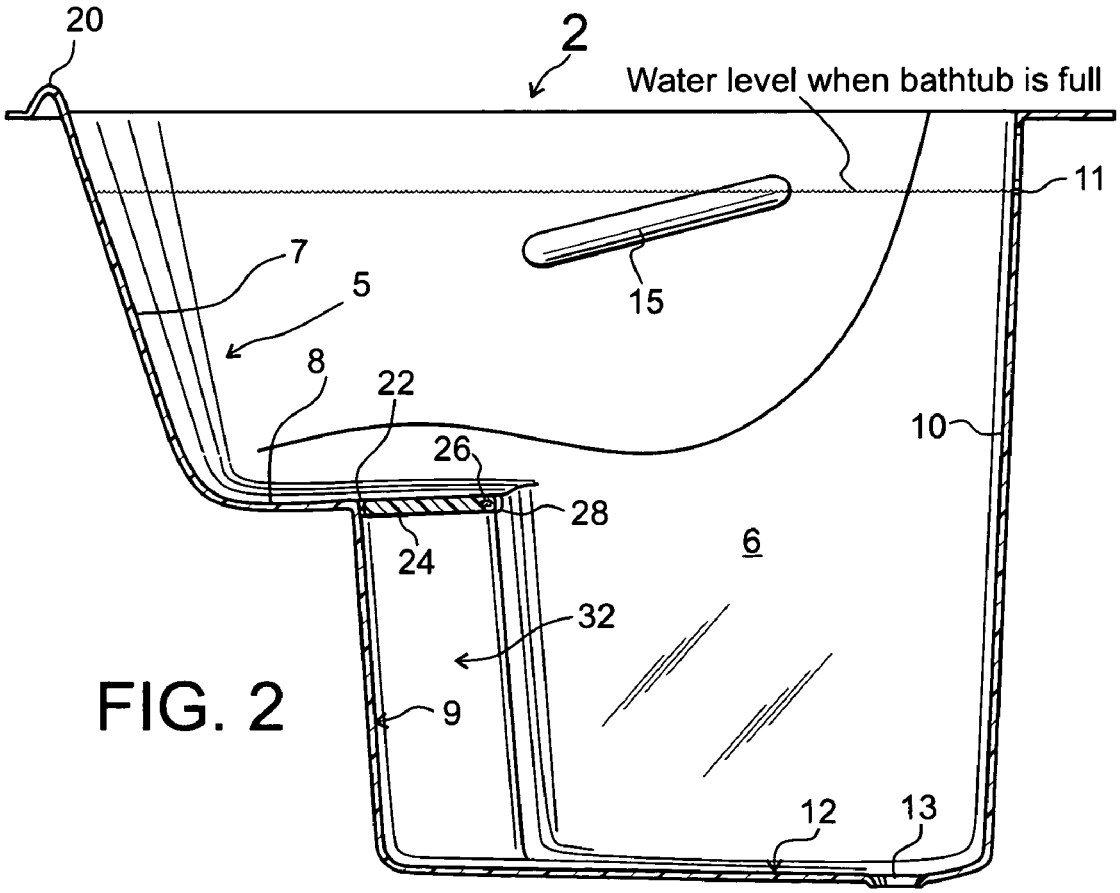
FIG. 2 is a cross-sectional view of the walk-in bathtub as viewed in direction 2-2 in FIG. 1.

As shown in FIG. 2, the molded seat rear end wall 5 has an upper back portion 7 that transitions into a generally horizontal middle fixed seat portion 8 that transitions into a lower wall 9. The lower wall 9 transitions into the bottom wall 12. Preferably, the middle fixed seat portion 8 is located about knee high above the bottom wall 12.

Figure 4:
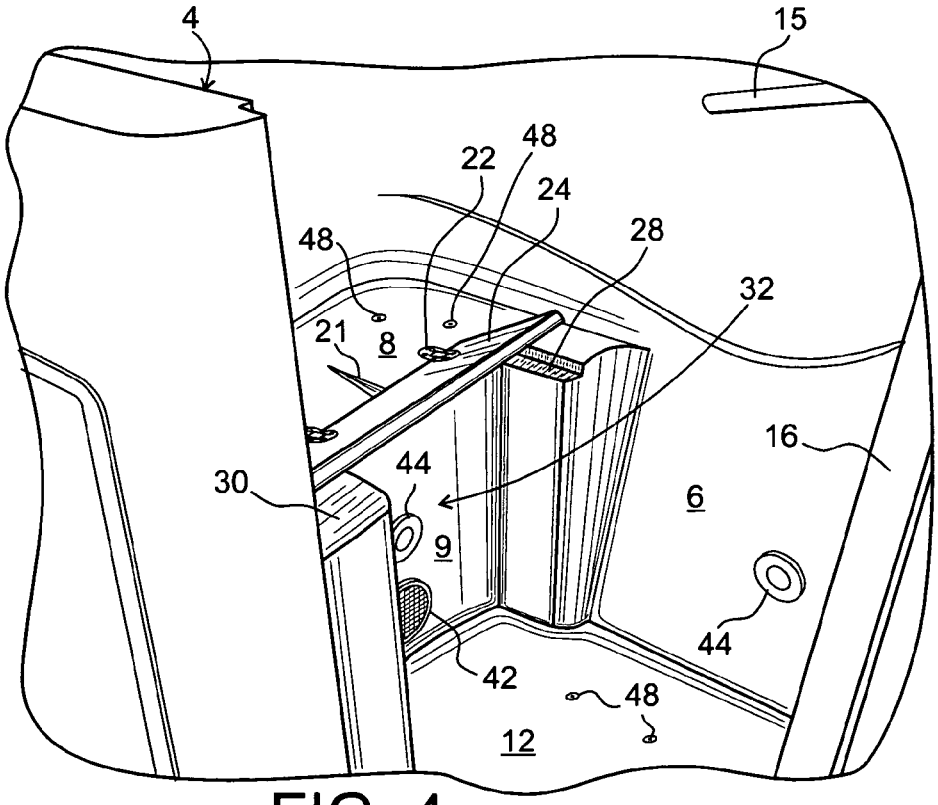
FIG. 4 is a perspective partial view of the improved bathtub from outside the open hinged door into an interior bathing cavity and showing the flip-up seat portion in a transitional intermediate position between the closed seat position and an open seat position.
Figure 5:
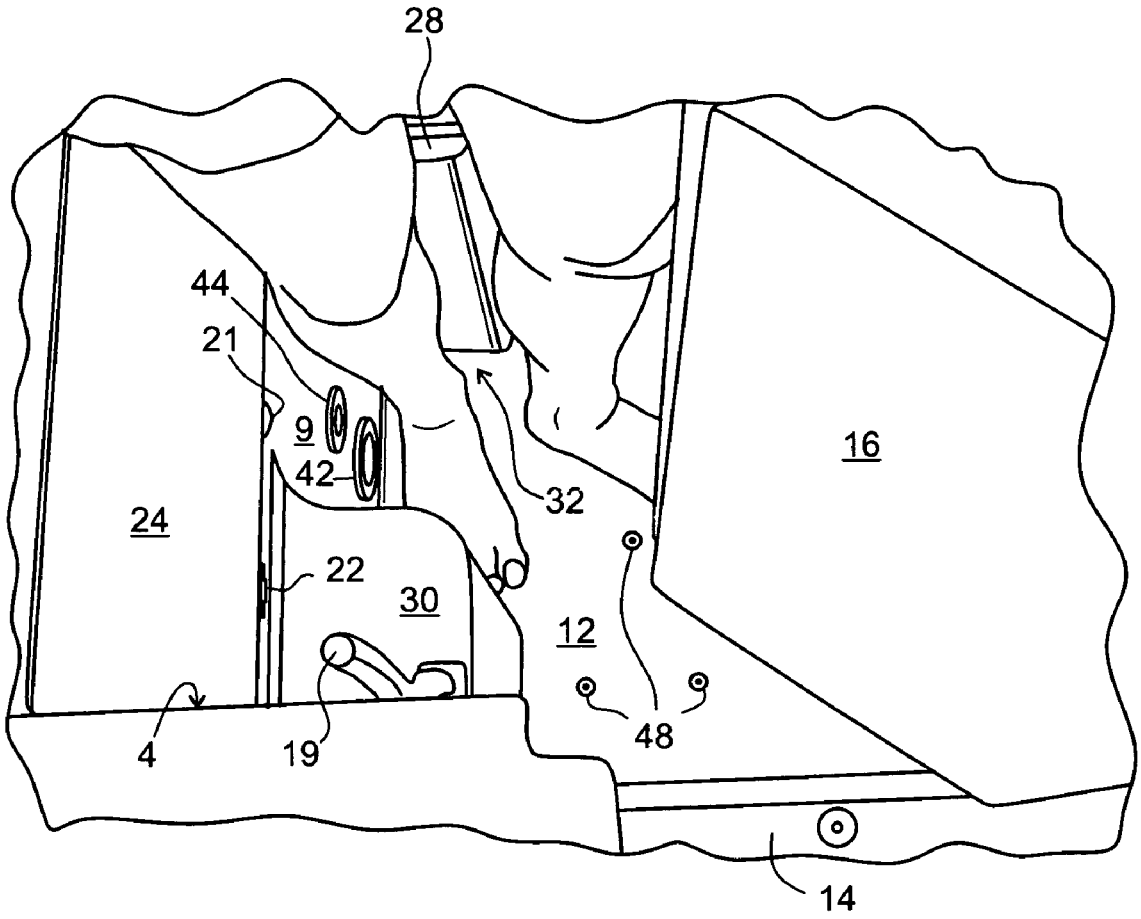
FIG. 5 is a perspective partial view of the improved bathtub from outside the open hinged door into an interior bathing cavity showing a flip-up seat portion in an open seat position, showing a door latch assembly in an open door position, showing a standing bather's right foot located within a rearward foot well recess, and showing the door in a transitional intermediate position between an open door position and a closed door position.
Figure 6:
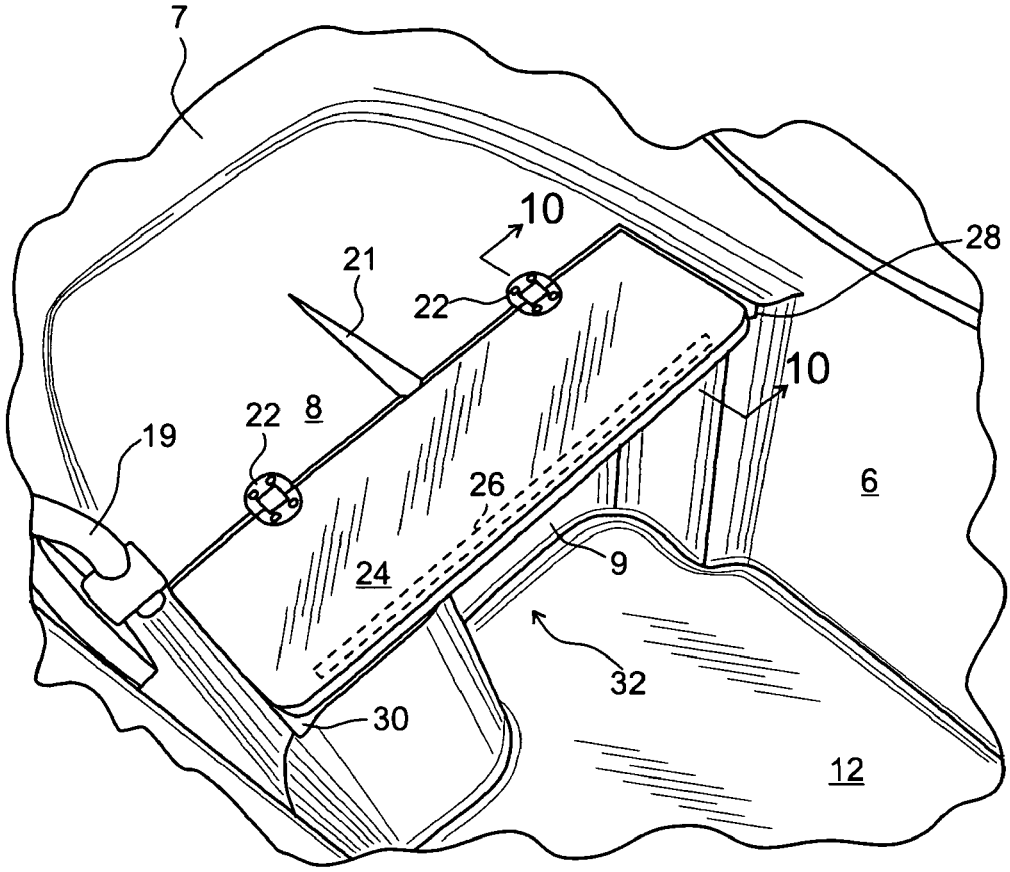
FIG. 6 is a perspective partial view of the improved bathtub from outside the open hinged door into an interior bathing cavity and showing the flip-up seat portion in a closed seat position over a rearward foot well recess.
Figure 7:
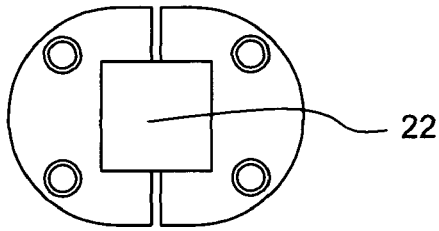
FIG. 7 is a top view of a flip-up seat hinge.
Figure 8A:
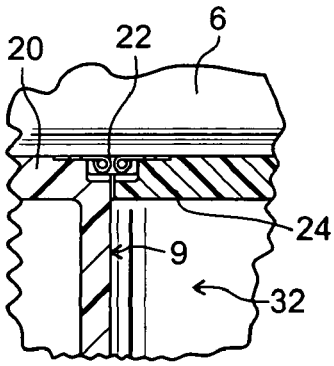
FIG. 8*a* is a partial cross-sectional view of a flip-up seat portion in a closed seat position.
Figure 8B:
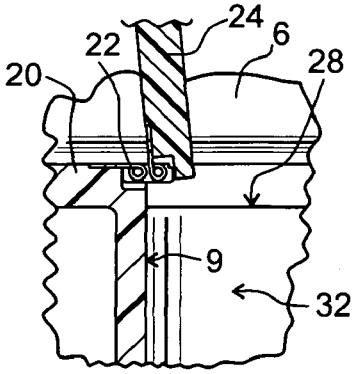
FIG. 8*b* is a partial cross-sectional view of a flip-up seat portion in a transitional intermediate position between the closed seat position and an open seat position.
Figure 8C:
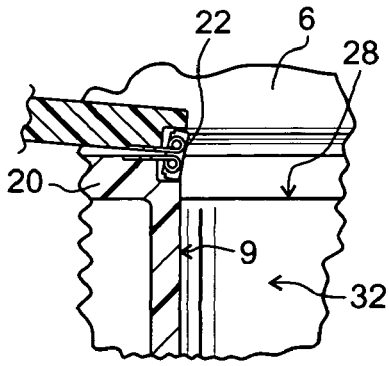
FIG. 8*c* is a partial cross-sectional view of a flip-up seat portion in the open seat position.

FIGS. 4 to 6 show two flip-up seat portion support ledges 28 and 30 spaced apart with said support ledges respectively located on two opposing side walls 4 and 6 said opposing side walls adjacent the fixed seat portion 8 and each said support ledge near the upper portion of the lower wall 9 and the support ledges bracketing a rearward foot well recess 32 and the rearward foot well recess located adjacent the lower wall.

A flip-up seat portion 24 is pivotally connected by a suitable hinging means to the fixed seat portion 8 preferably along a transition line between the fixed seat portion and the lower wall 9. Two stainless steel flip-up seat hinges 22 mounted by screws 23 to and between the fixed seat portion 8 and the rearward edge of the flip-up seat portion 24 comprise the preferred hinging means. A piano type hinge or a flexible web made of a suitable material could also be the hinging means to pivotally connect the flip-up seat portion 24 to the fixed seat portion 8 and attached to the flip-up seat portion and the fixed seat portion by using screws, nuts and bolts, adhesive, or other suitable fasteners. Other suitable fasteners could be substituted in place of the screws 23 to mount the preferred seat hinges 22.

The flip-seat portion 24 is selectively movable between a closed seat position resting on the support ledges 28 and 30 with the flip-seat portion covering the rearward foot well recess 32 and an open seat position overlaying the fixed seat portion 8 with the flip-seat portion uncovering the rearward foot well recess.

Preferably, when in the closed seat position, the flip-seat portion 24 is near knee height.

Preferably, the upper back portion 7 has a rounded upper edge 20 that can function as a head rest for a bather. Preferably, the fixed seat portion 8 has a water drainage channel 21 formed in the upper surface of the fixed seat portion near its midline spaced from, between, and generally parallel to the side walls 4 and 6. Preferably, the front end wall 10 has a bathtub water overflow opening 11 near its upper edge connected to appropriate plumbing (plumbing not shown) to guard against the bathtub overflowing and the bottom wall 12 has a drain opening 13 connected to appropriate plumbing (plumbing not shown) to permit draining of a bathtub filled with water.

Preferably, the bather entryway 14 is located in the sidewall 4 forward of the flip-up seat portion support ledge 30.

Figure 3:
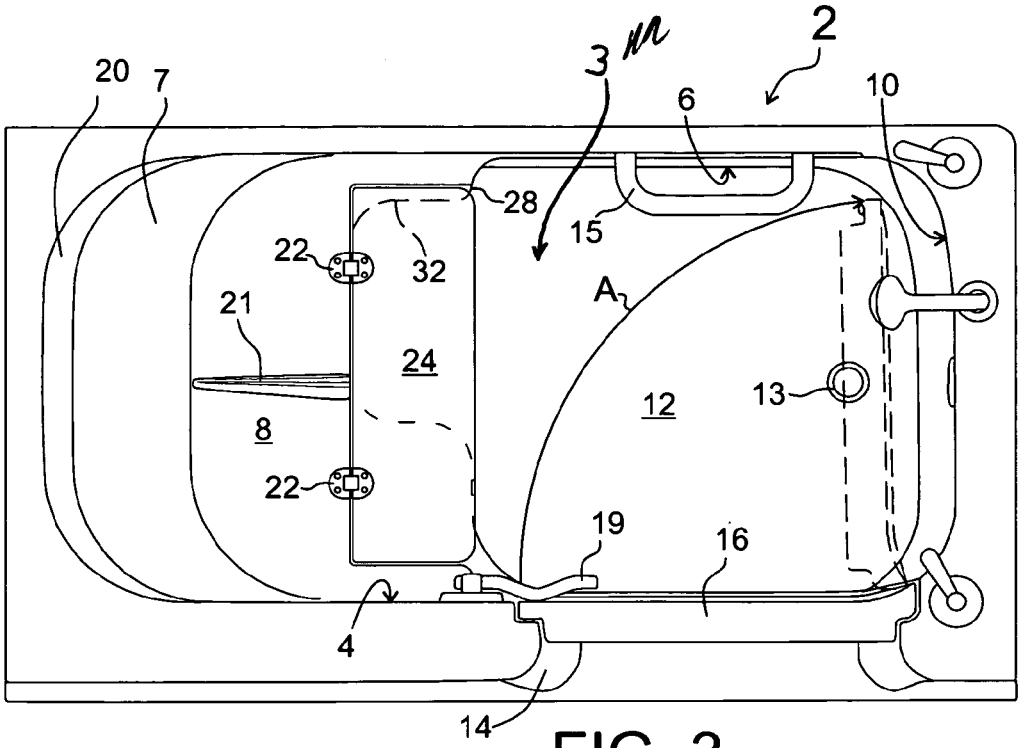
FIG. 3 is a top view of a walk-in bathtub having a flip-up seat portion in a closed seat position over a rearward foot well recess and showing an arrow A that indicates the arc of the hinged door from a closed door position to an alternate open door position and showing a door latch assembly on the inward facing surface of side wall 4 in the closed door position.

FIG. 3 shows an arrow A that indicates the arc that would be traced by the outer swinging free edge of the hinged door 16 moving from a closed door position to an open door position. FIG. 3 also shows the hinged door 16 held closed by a closable door latch assembly 19 attached to the inward surface of the side wall 4 adjacent the bather entryway 14 and shows a fixed seat portion 8 having a water drainage channel 21.

FIG. 3 shows an interior bathing cavity 3 of the bathtub 2, the interior bathing cavity having a bathtub flip-up seat portion 24 in a closed seat position over a rearward foot well recess 32.

Figure 9:
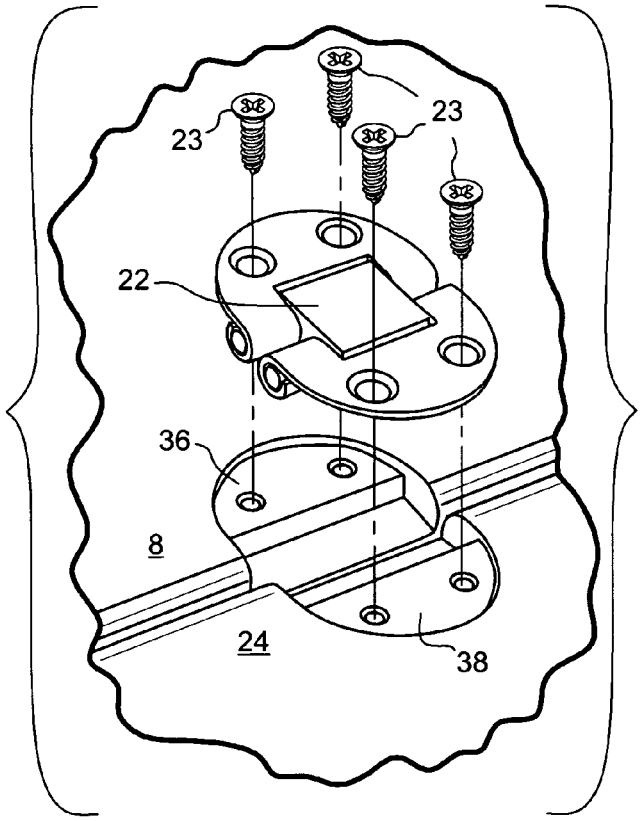
FIG. 9 is a partial exploded perspective view of a fixed seat portion, the flip-up seat portion, and a flip-up seat hinge.
Figure 10:
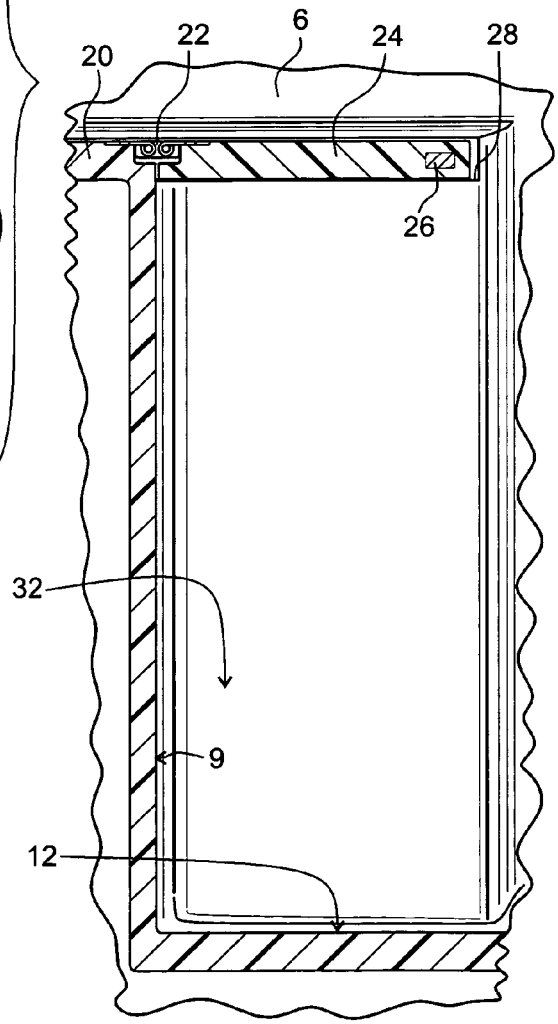
FIG. 10 is a partial cross-sectional view of the walk-in bathtub as viewed in direction 10-10 in FIG. 6 and showing a side view of the flip-up seat hinge.

FIG. 9 shows the preferred flush to the surface mounting of a flip-up seat hinge 22 in a fixed seat portion hinge mounting cavity 36 and in a flip-up seat portion hinge mounting cavity 38 by screws 23 (four in number).

Preferably, the flip-up seat portion 24 is made of high density polyethylene plastic that is more dense than water or is made of another suitable material that is denser than water and structurally strong enough to function as a seat portion. The flip-up seat portion 24 in the best embodiment has a seat weight 26 that can be made of lead or another suitably dense material embedded near the edge of the flip-up seat portion away from the hinging means to ensure that the flip-seat portion will remain in a bather selected position either in the closed seat position or in the open seat position when the bathtub is filled with water.

The bathtub 2 optionally can be equipped with a whirlpool, waterjet system having at least one water intake port 42 withdrawing water from and at least one waterjet port 44 discharging water into the bathing cavity 3.

Further, the bathtub 2 optionally can be equipped with an air injection system having at least one air jet orifice 48 for injecting air into the bathing cavity 3.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

I claim:

1. A walk-in bathtub having a flip-up seat portion over a rearward foot well recess said walk-in bathtub comprising an upwardly open interior bathing cavity defined by four side walls and a bottom wall, one of said side walls being a molded seat rear end wall opposite one of said side walls being a front end wall, said seat rear end wall having an upper back portion that transitions into a generally horizontal middle fixed seat portion that transitions into a lower wall, said lower wall transitions into said bottom wall, two flip-up seat portion support ledges spaced apart with said support ledges respectively located on two opposing side walls said opposing side walls adjacent said fixed seat portion and each said support ledge near the upper portion of said lower wall and said support ledges bracketing a rearward foot well recess, said rearward foot well recess located adjacent said lower wall, and a flip-up seat portion more dense than water pivotally connected by a hinging means to said fixed seat portion along a transition line between said fixed seat portion and said lower wall, said flip-seat portion selectively movable between a generally horizontal closed seat position resting on and bridging horizontally between said support ledges and covering said rearward foot well recess with said flip-up seat portion extending generally forward horizontally from said fixed seat portion towards said front end wall and an open seat position with said flip-up seat portion overlaying and generally horizontally facing said fixed seat portion and uncovering said rearward foot well recess and said support ledges.

2. A walk-in bathtub having a flip-up seat portion over a rearward foot well recess according to claim 1 further comprising a bather entryway in one of said side walls and an inwardly swinging sealable entryway hinged door mounted in said bather entryway by a door hinge adjacent to said front end wall.

3. A walk-in bathtub having a flip-up seat portion over a rearward foot well recess according to claim 1 wherein said hinging means comprising two flip-up seat hinges mounted between said fixed seat portion and the rearward edge of said flip-up seat portion flush to the upper seating surface of said fixed seat portion and flush to the upper seating surface of said flip-up seat portion in said closed seat position.

4. A walk-in bathtub having a flip-up seat portion over a rearward foot well recess according to claim 1 further comprising a seat weight embedded near the edge of said flip-up seat portion away from said hinging means.

* * * * *